US005211540A

United States Patent [19]

Evans

[11] Patent Number: 5,211,540

[45] Date of Patent: May 18, 1993

[54] SHROUDED AEROFOILS

[75] Inventor: Neil M. Evans, Bristol, Great Britain

[73] Assignee: Rolls-Royce plc, London, England

[21] Appl. No.: 804,756

[22] Filed: Dec. 11, 1991

[30] Foreign Application Priority Data

Dec. 20, 1990 [GB] United Kingdom ..... 9027583

[51] Int. Cl.[5] ..... F01D 5/22

[52] U.S. Cl. ..... 416/190; 416/191; 416/500

[58] Field of Search ..... 416/190, 191, 248, 500; 29/889.21, 889.22

[56] References Cited

U.S. PATENT DOCUMENTS

| | | | |
|---|---|---|---|
| 4,076,455 | 2/1978 | Stargardter | 416/500 |
| 4,155,152 | 9/1978 | Cretella | 416/191 |
| 4,589,175 | 5/1986 | Arrigoni | 416/190 |
| 4,710,102 | 12/1987 | Ortolano | 416/191 |

FOREIGN PATENT DOCUMENTS

| | | | |
|---|---|---|---|
| 135906 | 10/1979 | Japan | 416/190 |
| 110801 | 7/1983 | Japan | 416/900 |
| 2072760 | 10/1981 | United Kingdom | 416/190 |

*Primary Examiner*—John T. Kwon

*Attorney, Agent, or Firm*—Oliff & Berridge

[57] ABSTRACT

A shrouded aerofoil assembly such as a turbine rotor for a gas turbine engine has a multiplicity of blades with tip shrouds circumferentially distributed around a rotor disk. Inevitably, in use, the assembly vibrates and must be designed so the potentially most dangerous vibratory modes occur outside the engine speed range. The proposed arrangement has a number of neighbouring blades sharing a common shroud segment. Adjacent shroud segments are interlocked by Z-notch abutments. Blade assemblies have sufficient pre-twist load to maintain frictional contact in the interlocks over the speed range to maintain damping constraints.

8 Claims, 2 Drawing Sheets

SHROUDED AEROFOILS

BACKGROUND OF THE INVENTION

The invention relates to shrouded aerofoils. More particularly, the invention concerns an assembly or sub-assembly consisting of a plurality of shrouded turbine blades sharing a common tip shroud.

Gas turbine engines frequently employ tip shrouds on individual aerofoils to limit blade amplitudes when vibrating in a random manner and to guide fluid flow over the aerofoils. Neighbouring shrouds abut in the circumferential direction to add mechanical stiffness. When a series of such assemblies are mounted together the shrouds define in effect a continuous annular surface. Opposite edges of the shrouds in the circumferential direction are provided with abutment faces and are designed to introduce to the assembly desired constraints. In order to keep natural blade frequencies high and to avoid low engine order bladed disk resonances as well as damping random blade resonances it is known to incorporate Z-notches in the abutments. These separate that portion of the shroud that retains clearance with its neighbour from that part that is abutting the shroud abutment faces. By pre-twisting the blade aerofoils, portions of adjacent shroud abutment face are maintained in frictional contact thereby constraining the assembly from certain modes of vibration.

It is also known to weld the blade tip shrouds of neighbouring blades into pairs either to raise a blade resonant frequency out of the engine operating range. Also, this can be effective to prevent shroud tilting.

The present invention according to its broadest aspect provides a shrouded aerofoil assembly comprising at least two blades sharing a common circumferential shroud ring segment which has at opposite ends in the circumferential direction notched abutment faces.

SUMMARY OF THE INVENTION

According to one aspect of the invention a shrouded aerofoil rotor assembly comprising an annular array of shrouded aerofoil sections each of which comprises a plurality of aerofoil blades sharing a common circumferential shroud segment opposite ends of which in the circumferential directions are notched to interlockingly engage with a correspondingly shaped shroud segment of a neighbour section.

Preferably each segment comprises at least two blades and a common radially outer shroud segment and a shroud segment end face incorporates a Z-notch which includes an inter-segment abutment face which extends longitudinally in a circumferential direction.

According to a further aspect of the invention in a shrouded aerofoil assembly of the type referred to the interference angle of the notched abutment interface is substantially zero.

BRIEF DESCRIPTION OF THE DRAWINGS

The invention will now be described in greater detail with reference, by way of example only, to the accompanying drawings, in which.

Vibration of engine components and assemblies especially of rotating parts is potentially a very serious problem. It is a mandatory requirement to keep certain resonant frequencies and harmonics outside the limits of an engine running speed range. In this context the resonant frequency of a bladed disk assembly is critical. It is mandatory that a 2D/2EO resonance lies outside a rotor stage speed range. 2D/2EO describes a vibration mode of a bladed disk about two orthogonal diameters (2D) in the plane of the disk at a frequency which is twice engine rotation speed (2EO).

Figure 3:
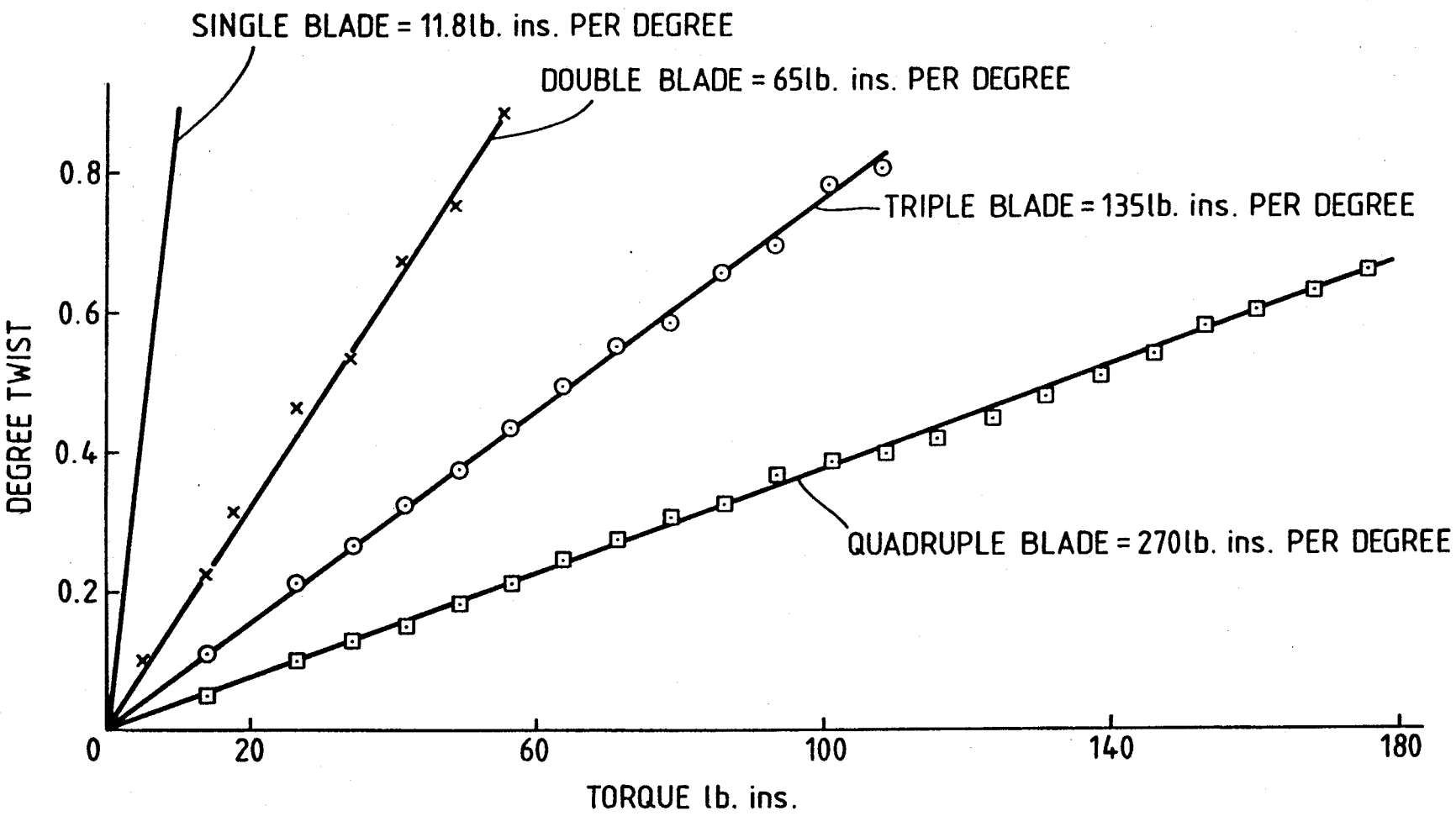
FIG. 3 shows for comparison graphical plots of the stiffness of various segments containing different numbers of blades.

A significant increase in a two diameter bladed disk resonance can be achieved by welding blades into pairs, or greater numbers. In the accompanying drawings, FIG. 3 illustrates the effect on stiffness of compounding the number of blades in a shrouded rotor segment. A further significant increase in resonant frequency can be achieved by the use of interlocking shrouds providing the torsional stiffness of the segments is sufficient to ensure the shrouds remain fully constrained by the interlocks throughout the operating range.

Figure 1:
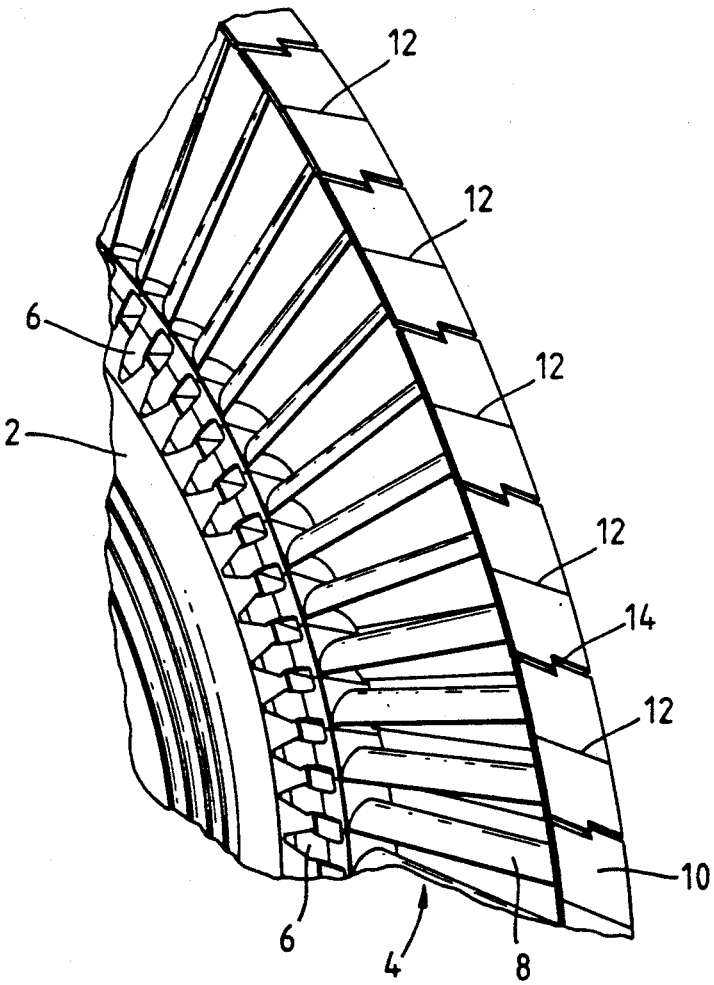
FIG. 1 shows a perspective view of a sector of a shrouded turbine disc.
Figure 2:
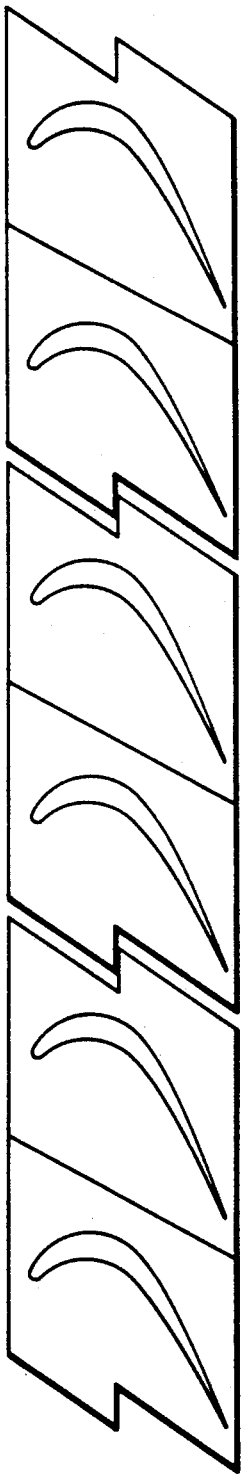
FIG. 2 is a diagram schematically illustrating the angles of the interfering abutment faces of the shrouds.

Referring now to FIG. 1, there is shown a portion of a shrouded turbine assembly. A part of the turbine disk is drawn at 2. A plurality of turbine blades 4 is mounted on the rim of the disk 2 by means of firtree root fixings. Each blade has a root 6 seated in a correspondingly shaped axially oriented groove in the disk rim. Each turbine blade 4 also has a curvlinear aerofoil 8 and is joined to, or formed integrally with, a shroud 10 at the tip of the aerofoil 8. All of these components are conventional in design and structure and will not be described further in detail.

The standard design philosophy for solid turbine blades has been to establish the chord based on (among other parameters) blade aspect ratio. For minimum weight, design aspect ratio is set as high as aerofoil bending stresses will allow.

In addition to steady state bending stresses it is also important to keep natural blade frequencies high enough and avoid low engine order bladed disk resonances as well as providing damping of random blade resonances that occur as the turbine speed changes from one steady state condition to another within the flight envelope.

To achieve these objectives 'Z' notches are incorporated in shroud abutments. Portions of the notched shroud side face are maintained in interference with its neighbours by pretwisting the blade aerofoils during assembly of the blades into the disk. In order to be effective the interlocking shroud interference must be sufficient to constrain shroud movement such that blade and bladed/disk frequencies are raised sufficiently to move dangerous resonances outside the engine operating speed range. Where this constraint cannot be achieved, blade and disk amplitudes under vibratory forces must be maintained at an acceptable level by damping.

Where blades are relatively stiff in torsion the interlocking shrouds constrain tip movement. If the constraint is sufficient to eliminate the first family of natural frequencies (ie IF,IE,IT) bladed/disk resonances are raised significantly. These frequencies are replaced by a significantly higher first family restricted frquencies indicated by IFR etc. Where blades are relatively very weak in torsion the shrouds will not be fully constrained and the lower bladed/disk frequencies will prevail.

This latter situation results in a particularly difficult problem when dealing with low engine order (EO) bladed disk resonances. There is a mandatory requirement to ensure that the second EO bladed disk resonance does not appear in the engine operating speed range because of the potential hazard to disk integrity.

Interlocking shrouds eliminate IF,IE and IT providing interference is maintained. These fundamental frequencies are replaced by their restricted counterparts eg IFR, ITR etc where the natural frequencies are very much higher (approximately $\times 6$).

Frequency tests carried out on blades welded into pairs at the shroud have shown the IF to be present but at a higher level (approximately 30%) ie the blades are vibrating as a "portal frame".

In accordance with the present invention adjacent aerofoils share common shroud ring segments so that a whole rotor assembly comprises a plurality of such segments. Each aerofoil blade segment comprises a common circumferential shroud segment and two or more aerofoil blades. The shared shroud segment consists of a single shroud element formed integrally with the plurality of blades, say two, three, four etc Alternatively, each aerofoil blade is formed with an individual shroud and in each bladed section the shrouds are joined by welding neighbouring edges. The edges to be joined are preferably formed straight. Occasional shroud edges are formed with interlock notched faces.

In the accompanying drawings the aerofoil shrouds are welded at 12 to form welded pair segments. An interference abutment incorporating the principle of interlocking shrouds faces as at 14 in the drawings is provided between adjacent welded aerofoil segments. The abutment faces in a complete rotor assembly each subtend a predetermined angle with respect to a circumference of the assembly. During assembly of the rotor each shrouded section is twisted to urge abutting interlock faces to positively engage. The stiffness of the blade and common shroud segment is designed to be such that the pre-twist laod is sufficient to maintain positive engagement of abutting faces over the rotor operating range.

As is apparent in FIG. 3 welding blades into pairs significantly increases the blade torsional stiffness. It should therefore be possible to ensure a 'fixed' interlock by first welding blades into pairs and then incorporating the interlock with the paired blades.

While operating within the flight envelope a turbine experiences a significant range of pressure drop and speed. In order to minimise bending on a blade aerofoil the blade is leaned away from a purely radial stacking line such that gas bending moments are partially balanced by centrifugal force induced offset bending moments.

A standard procedure for reducing aerofoil bending stresses in NGV's has been to join them together at the end platforms into pairs, multiples or even complete rings. For a standard paired vane (constant section) for example, where gas loads are taken out through the casing, the tangential gas bending moments at the outer aerofoil position will be 33% lower than for the corresponding single vane. Reduced deflections and zero tilt of the inner platform in the circumferential plane are additional benefits accruing from multiple vane structures.

A problem arises in designs incorporating tip shrouds welded into pairs. Although with single blades the fundamental natural blade frequencies can be raised well out of the engine operating range by an interfering 'Z' shroud, a "welded into pairs" interference shroud would tend to force the blade aerofoils out of the plane of the disk.

In a shrouded aerofoil bladed disk assembly an array of shrouded aerofoil segments are mounted by means of root mountings on the periphery of a rotor disk. The aerofoil blade segments are formed with a root which engages with a root receiving slot formed in the disk periphery. The angular orientation of said root and said slot are formed so the blade segments must be twisted about a disk radius during assembly in order to engage the shroud interlocks. The blade root fixings are machined at the required aerofoil pretwist angle relative to the disk/blade assembly slot. When the 'welded into pairs' blades are then assembled into the disk slots, the aerofoils are twisted to the prescribed angle provided the tip shrouds are held in plane. Providing the blade segments are sufficiently stiff the interaction of the notched abutments on the shrouds damp blade vibration over the whole operating range.

Any movement out of plane at the shroud position is prevented by incorporating a 'Z' notch on the outer side faces of the shroud and dimensioned such that on assembly the shrouds will be in the correct plane.

After assembly the static forces in blade aerofoils, root fixings and disks are no different than with single 'Z' shrouded blades. Where the normal shroud interface angle of 45° is applied however, the relative changes in shroud width to circumferential pitch resulting from thermal and centrifugal growths of disk and blades throughout the running range will once again force the blade tips out of plane from the disk.

This problem is overcome in accordance with the invention by reducing the shroud interface angle to zero. Any relative circumferential growth of the shroud ring can thus occur without inducing shroud movement in the axial direction.

Introducing shrouds welded into pairs whilst retaining shroud interference between pairs utilising the 'Z' notch principle raises low EO bladed/disk resonances whilst retaining the advantages of high blade natural frequencies and shroud damping of the 'Z' notched shroud. Also there is significant reduction in root and aerofoil bending moments which can be utilised either to increase aerofoil orthogonality, to reduce turbine stage weight, or to increase aerofoil and root fatigue reserves.

Significant reductions in tip deflection and circumferential shroud tilt achieved by the invention compared with single blades result in improved tip leakage control and reduced engine weight.

I claim:

1. A shrouded aerofoil rotor assembly comprising:

an annular array of shrouded aerofoil segments each of which comprises at least two aerofoil blades which share a common radially outer circumferential shared shroud segment, the shared shroud segment having opposite ends in the circumferential direction which are formed with notches to interlockingly engage with notches formed in the correspondingly shaped ends of neighbouring shared shroud segments, each shared shroud segment comprising at least two shroud sections formed integrally with their respective aerofoil blades, a shroud section is formed with at least one edge in a circumferential direction which on assembly lie adjacent edges of neighbouring shroud sections, and a shared shroud segment is formed by welding together at least two adjacent shroud sections at said adjacent edges, wherein during assembly of the rotor, each shared shroud segment is pre-twisted to urge abutting interlock faces to positively engage and the pre-twist load is sufficient to maintain positive engagement of the abutting interlock faces over the whole rotor operating speed.

2. A shrouded aerofoil rotor assembly as claimed in claim 1 wherein a shroud segment is provided with an end face which incorporates a Z-notch having an inter-segment abutment face which extends longitudinally in a circumferential direction.

3. A shrouded aerofoil rotor assembly as claimed in claim 2 wherein the abutment faces in a complete rotor assembly each subtend a predetermined angle with respect to a circumference of the assembly.

4. A shrouded aerofoil rotor assembly as claimed in claim 3 wherein the predetermined angle is substantially zero.

5. A shrouded aerofoil rotor assembly as claimed in claim 1 comprising a bladed disk including a rotor disk on the periphery of which the array of shrouded aerofoil sections are mounted by means of root mountings, wherein the aerofoil blade segments are formed with a root which engages with a root receiving slot formed in the disk periphery, the angular orientation of said root and said slot being such that the blade segments must be twisted about a disk radius during assembly in order to engage the shroud interlocks.

6. A shrouded aerofoil rotor assembly as claimed in claim 5 wherein the said angular orientation is obtained by machining the faces of the blade segment root.

7. A shrouded aerofoil rotor assembly as claimed in claim 1, wherein:

said adjacent edges to be joined by welding are formed straight, and the edges of adjacent shroud segments which upon assembly abut in a circumferential direction are formed with notched faces.

8. A shrouded aerofoil rotor assembly comprising:

an annular array of shrouded aerofoil segments each of which comprises at least two aerofoil blades which share a common radially outer circumferential shared shroud segment, the shared shroud segment having opposite ends in the circumferential direction which are formed with notches to interlockingly engage with notches formed in the correspondingly shaped ends of neighbouring shared shroud segments, each shared shroud segment comprising a shroud section formed integrally with a plurality of aerofoil blades, and a shroud section is formed with at least one edge in a circumferential direction which on assembly lie adjacent edges of neighbouring shroud sections, wherein said adjacent edges to be joined by welding are formed straight, and the edges of adjacent shroud segments which upon assembly abut in a circumferential direction are formed with notched faces; and during assembly of the rotor, each shared shroud segment is pre-twisted to urge abutting interlock faces to positively engage and the pre-twist load is sufficient to maintain positive engagement of the abutting interlock faces over the whole rotor operating speed.

* * * * *